US006842592B2

(12) United States Patent
Kinoshita

(10) Patent No.: US 6,842,592 B2
(45) Date of Patent: Jan. 11, 2005

(54) IMAGE FORMING APPARATUS

(75) Inventor: Hidehiko Kinoshita, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/642,700

(22) Filed: Aug. 19, 2003

(65) Prior Publication Data

US 2004/0052542 A1 Mar. 18, 2004

Related U.S. Application Data

(63) Continuation of application No. 10/122,447, filed on Apr. 16, 2002, now abandoned.

(51) Int. Cl.[7] ..... G03G 15/20; G03G 15/00

(52) U.S. Cl. ..... 399/69; 399/43; 399/45; 399/68

(58) Field of Search ..... 399/43, 45, 67, 399/68, 69, 320, 322, 328, 391, 400; 347/156; 219/216

(56) References Cited

U.S. PATENT DOCUMENTS

| | | | | | |
|---|---|---|---|---|---|
| 4,585,325 | A | * | 4/1986 | Euler | 399/69 |
| 4,905,051 | A | * | 2/1990 | Satoh et al. | 399/69 |
| 5,111,249 | A | * | 5/1992 | Owada | 399/69 |
| 5,550,621 | A | * | 8/1996 | Ogawahara | 399/69 |
| 5,561,512 | A | * | 10/1996 | Fukano et al. | 399/69 |
| 5,580,042 | A | | 12/1996 | Taniguro et al. | 271/274 |
| 5,620,174 | A | | 4/1997 | Taniguro et al. | 271/10.12 |
| 5,672,019 | A | | 9/1997 | Hiramatsu et al. | 400/624 |
| 5,725,319 | A | | 3/1998 | Saito et al. | 400/629 |
| 5,742,865 | A | * | 4/1998 | Yajima et al. | 399/43 |
| 5,895,142 | A | * | 4/1999 | Takahashi et al. | 399/391 X |
| 6,168,270 | B1 | | 1/2001 | Saikawa et al. | 347/104 |
| 6,466,751 | B1 | * | 10/2002 | Kawano | 399/68 |

FOREIGN PATENT DOCUMENTS

| | | |
|---|---|---|
| JP | 2-138074 | 5/1990 |
| JP | 3-97372 | 4/1991 |
| JP | 8-107476 | 4/1996 |

* cited by examiner

*Primary Examiner*—Sandra Brase
(74) *Attorney, Agent, or Firm*—Fitzpatrick, Cella, Harper & Scinto

(57) ABSTRACT

An image forming apparatus includes an image forming device for forming an unfixed image on a recording material transported thereto, the image forming device being capable of continuously effecting image formation on recording materials differing in the width thereof in a direction orthogonal to the transport direction thereof, a fixing device having a heat member and for fixing the unfixed image by the use of heat and pressure, and a recording material changeover device capable, when images are to be continuously formed on recording materials smaller in the width thereof in the direction orthogonal to the transport direction than a maximum width with which the recording materials can be passed, of changing over the recording materials to recording materials greater in the width thereof in the direction orthogonal to the transport direction than the recording materials on which images are being formed in the course of continuous image formation.

46 Claims, 14 Drawing Sheets

IMAGE FORMING APPARATUS

This is a continuation of U.S. patent application Ser. No. 10/122,447, filed on Apr. 16, 2002, now abandoned.

BACKGROUND OF THE INVENTION

1. Field of the Invention

The invention relates to an image forming apparatus provided with image forming means, recording material supplying means having a plurality of recording material stacking portions, and fixing means having a heat member, and adapted to form an image on a recording material from the recording material supplying means by the image forming means, and fix the image by the application of heat by the fixing means.

2. Description of Related Art

There are known various image forming apparatuses, and above all, electrophotographic type image forming apparatuses spread widely. The electrophotographic type image forming apparatuses include a copying machine, a printer (such as an analog or digital printer using a laser beam or an LED), a facsimile apparatus, a word processor, etc., and each of these is usually provided with image forming means, recording material supplying means having a plurality of recording material stacking portions, and fixing means having a heat member.

As the heat member of the fixing means, use is generally made of a fixing roller heated by a heater, and a recording material is passed between the fixing roller and a pressure roller disposed in opposed relationship therewith, and a toner image on the recording material is fixed by the application of heat to thereby form a permanent image. When the recording material passes while being in contact with the fixing roller, the contact portion (passing portion) thereof has its heat taken by the recording material and therefore the surface temperature thereof lowers. For this reason, heater control is effected so as to maintain the surface temperature of the fixing roller at a value suited for fixing.

However, when the surface temperature of the recording material passing portion of the fixing roller is detected and the fixing roller is maintained at a temperature suited for fixing, the end portions of the fixing roller the recording material does not pass have their heat not taken by the recording material and therefore, the surface temperature of the end portions rises above the temperature suited for fixing, and temperature unevenness occurs between the central portion and end portions of the fixing roller. This temperature unevenness becomes greater when recording materials are continuously passed, and this leads to the problem that the end portions become high in temperature and these portions and the portions around them are heat-damaged. There also arises the problem that the non-passing portions are excessively heated and therefore electrical energy is uselessly consumed.

SUMMARY OF THE INVENTION

It is an object of the present invention to provide an image forming apparatus in which when recording materials of a width narrower a fixable maximum width continuously pass a fixing device, a temperature suited for fixing is maintained and yet the temperature rise of non-passing portions is suppressed and the waste of electrical energy is eliminated.

It is another object of the present invention to provide an image forming apparatus having recording material changeover means capable of changing over a recording material to a recording material greater in the width thereof in a direction orthogonal to the transport direction than a recording material on which an image is being formed in the course of continuous image formation when images are to be continuously formed on recording materials smaller in the width thereof in the direction orthogonal to the transport direction than the passable maximum width of the recording materials.

It is still another object of the present invention to provide an image forming apparatus having first temperature detecting means for detecting the surface temperature of a heat member in a portion thereof a minimum recording material in a direction orthogonal to the transport direction passes, second temperature detecting means for detecting the surface temperature of the heat member in a location differing that of the first temperature detecting means, and recording material changeover means capable of changing over a recording material to a recording material greater in the width thereof in the direction orthogonal to the transport direction than a recording material on which an image is being formed on the basis of the second temperature detecting means when an image is to be formed on a recording material smaller in the width thereof in the direction orthogonal to the transport direction than a maximum width.

It is yet still another object of the present invention to provide an image forming apparatus having count means for counting the number of records of recording materials, and having recording material changeover means capable of changing over a recording material to a recording material greater in the width thereof in a direction orthogonal to the transport direction than a recording material on which an image is being formed on the basis of the count means when an image is to be formed on a recording material smaller in the width thereof in the direction orthogonal to the transport direction than a maximum width.

Further objects of the present invention will become apparent from the following description.

DETAILED DESCRIPTION OF THE PREFERRED EMBODIMENTS

A fixing device and an image forming apparatus according to the present invention will hereinafter be described in greater detail with reference to the drawings.

Figure 1:
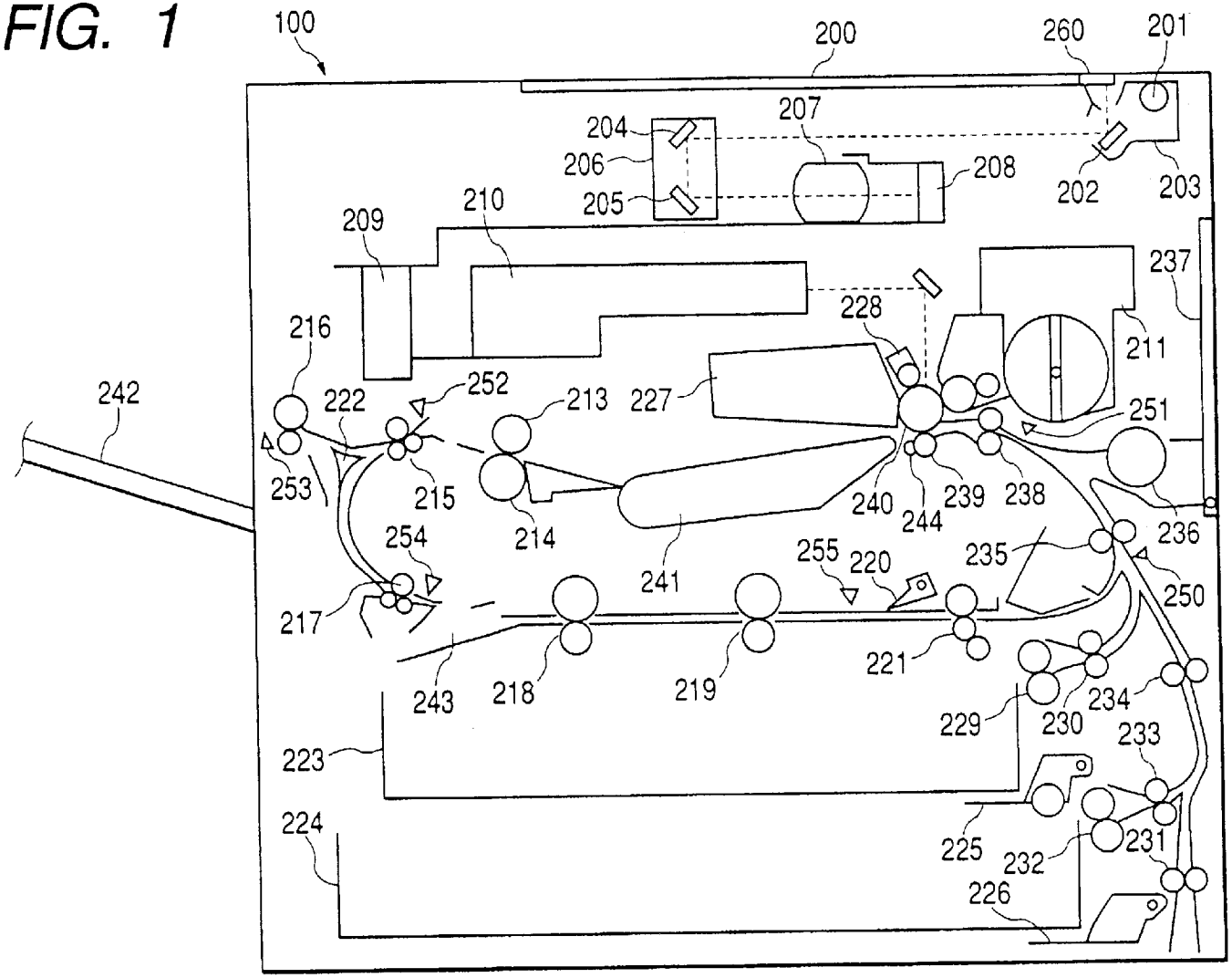
FIG. 1 shows the general construction of an image forming apparatus according to the present invention.

FIG. 1 shows the general construction of the image forming apparatus according to the present invention. An electrophotographic type digital copying machine which is the image forming apparatus is provided chiefly with image forming means, recording material supplying means having a plurality of recording material stacking portions, and fixing means having a heat member. Each portion will hereinafter be described specifically.

Image Forming Means

The image forming means is comprised of an exposing portion, a latent image forming portion, a developing portion and a transferring portion. The exposing portion is provided with an original placement stand (original stand) 200, a standard white plate 260, a first movable member 203 comprised of an exposure lamp 201 comprising an elongate fluorescent lamp, a halogen lamp or the like and a first mirror 202, a second movable member 206 comprised of second and third mirrors 204 and 205, a lens 207, a CCD line sensor 208, an exposure controlling portion 210 and a cooling fan 209 for cooling it.

The latent image forming portion is provided with a drum-shaped photosensitive member 240 which is an image bearing member. The developing portion is comprised of a developing device 211 and is provided with a container for containing a developer (toner) of a predetermined color therein and a developing roller or the like for supplying the toner to the photosensitive member 240. The transferring portion is comprised of a transfer charger 239, and transfers a toner image formed on the surface of the photosensitive member 240 onto a recording material supplied from the recording material supplying means by a voltage applied to the transfer charger.

The operation of the image forming means will now be described. First, when an original is irradiated by the exposure lamp 201 of the first movable member 203 while the first movable member 203 is moved, scattered light from the surface of the original is reflected by the first, second and third mirrors 202, 204 and 205 and arrives at the lens 207. At that time, the second movable member 206 is moved at a moving speed of ½ relative to the first movable member 203, and the distance from the irradiated surface of the original to the lens 207 is always maintained constant.

The image on the surface of the original which has arrived at the lens 207 is sequentially photoelectrically converted at a line unit by the CCD line sensor 208 comprising thousands of light receiving elements arranged in a line shape, and the electrical signal thereof is processed by a signal processing portion (not shown) and is PWM-modulated and outputted.

The exposure controlling portion 210 drives a semiconductor laser by the PWM-modulated image signal, and applies the light beam (laser beam) thereof to the surface of the photosensitive member 240 being rotated at a constant speed. At that time, the light beam is deflected and scanned in parallelism to the axial direction of the drum-shaped photosensitive member 240 by a polygon mirror (not shown).

The standard white plate 260 is used, when correcting the unevenness (shading distortion) of the output level of the image signal attributable to the non-uniformity of the sensitivity of the CCD line sensor 208, the non-uniformity of the light source the quantity of light, etc., to obtain the shading correction data thereof. Prior to the scanning of the original, the CCD line sensor 208 scans this standard white plate 260 several times, and white image data obtained thereby is used as the shading correction data, and the level non-uniformity correction (shading correction) of an image signal obtained by scanning the image of the original by the CCD line sensor 208 is effected.

On the other hand, the photosensitive member 240, prior to the application of the light beam thereto, has any residual charges on its surface eliminated by a pre-exposure lamp (not shown), and further has its surface uniformly charged by a primary charger 228. Accordingly, the surface of the photosensitive member 240 being rotated at the constant speed selectively receives the light beam including image information and an electrostatic latent image is formed thereon. The electrostatic latent image is developed with the toner of the predetermined color by the developing device 211, and is visualized as a toner image. This developed image is transferred onto the recording material supplied from the recording material supplying means, by the action of the transfer charger 239, as previously described.

Figure 2:
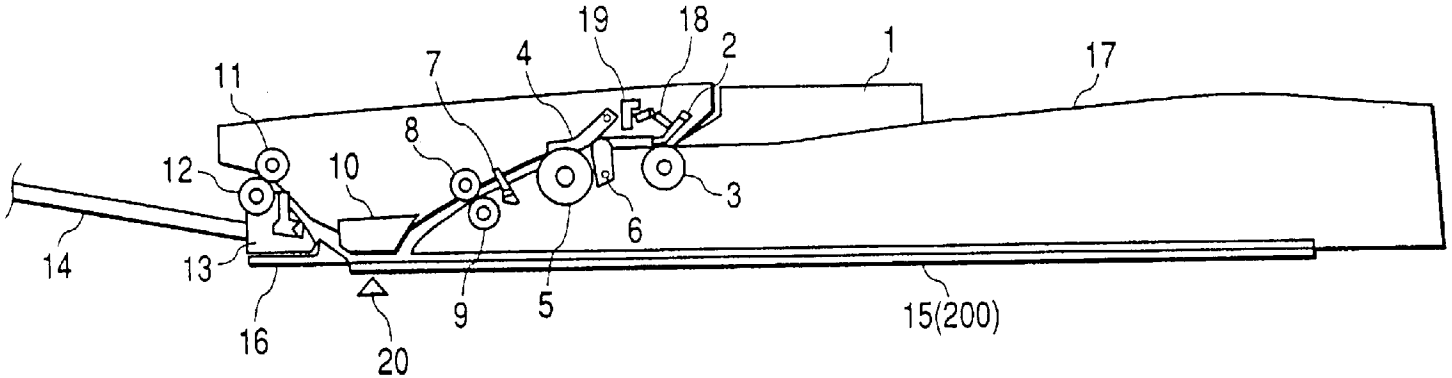
FIG. 2 is a cross-sectional view of an auto original feeder (ADF) mounted as an option on an original placement stand (original stand) 200 in FIG. 1 for automatically feeding an original.

FIG. 2 is a cross-sectional view of an auto original feeder (hereinafter referred to as the ADF) mounted as an option on the original placement stand (original stand) 200 for automatically feeding an original. The ADF is mountable to and dismountable from the main body of the image forming apparatus, and is of structure like a lid openable and closable relative to the original stand 200 of FIG. 1, and FIG. 2 shows the ADF in its closed state in which the ADF is operable.

In FIG. 2, the reference numeral 1 designates a side regulating member for effecting the positioning of the original, the reference numerals 2 and 4 denote roller pressers, the reference numeral 3 designates a feed roller, the reference numeral 5 denotes a separation roller, the reference numerals 6, 7 and 13 designate lever switches for detecting the passing state of the original during the original feeding operation, the reference numerals 8 and 9 denote a pair of registration rollers, the reference numeral 10 designates an original presser, the reference numerals 11 and 12 denote sheet discharge rollers, the reference numeral 14 designates a sheet discharge tray, the reference numeral 17 denotes an original stacking tray portion, the reference numeral 18 denotes a lever, the reference numeral 19 designates a stopper, and the reference numeral 20 designates a position in which the original comes into close contact with an original glass stand 15. The original glass stand 15 is on the main body side and corresponds to the original placement stand 200 of FIG. 1, and the reference numeral 16 denotes a dash plate provided on the main body side. The ADF is electrically connected to the main body by a cable (not shown) so as to be operable jointly with the main body.

The operation of the ADF will now be described. First, an operator places originals on the original stacking tray portion 17 with the image surfaces thereof facing downward, sets the side regulating member 1, and operates the copy start key 305 of an operating portion which will be described later to thereby start the recording operation or the like, whereupon an original feed starting signal is sent from the main body to the ADF through the cable to thereby start the original feeding operation.

In case of original feeding, the lever 18 depresses the roller presser 2 and upwardly raises the stopper 19, and the feed roller 3 is rotated to feed the originals, and the separation roller 5 and the roller presser 4 separate the originals received from the feed roller 3 one by one and feed them rearwardly. Then the pair of registration rollers 8 and 9 feed the original received from the separation roller 5 to between the original presser 10 and the original glass stand 15. The original presser 10 has the function of directing the original supplied from the pair of registration rollers 8 and 9 onto the original glass stand 15. Also, the original presser 10 is urged moderately toward the original glass stand 15 by a spring member, not shown, so that the original may closely contact with the original glass stand 15.

When the ADF as described above is used, the first movable member 203 shown in FIG. 1 is moved to below the position 20 in which the original comes into close contact with the original glass stand 15 and is stopped there. In that state, the image on the surface of the original moved at a constant speed by the ADF is scanned (photoelectrically converted) by the CCD line sensor 208. The original after scanned is discharged onto the sheet discharge tray 14.

Operating Portion

Figure 4:
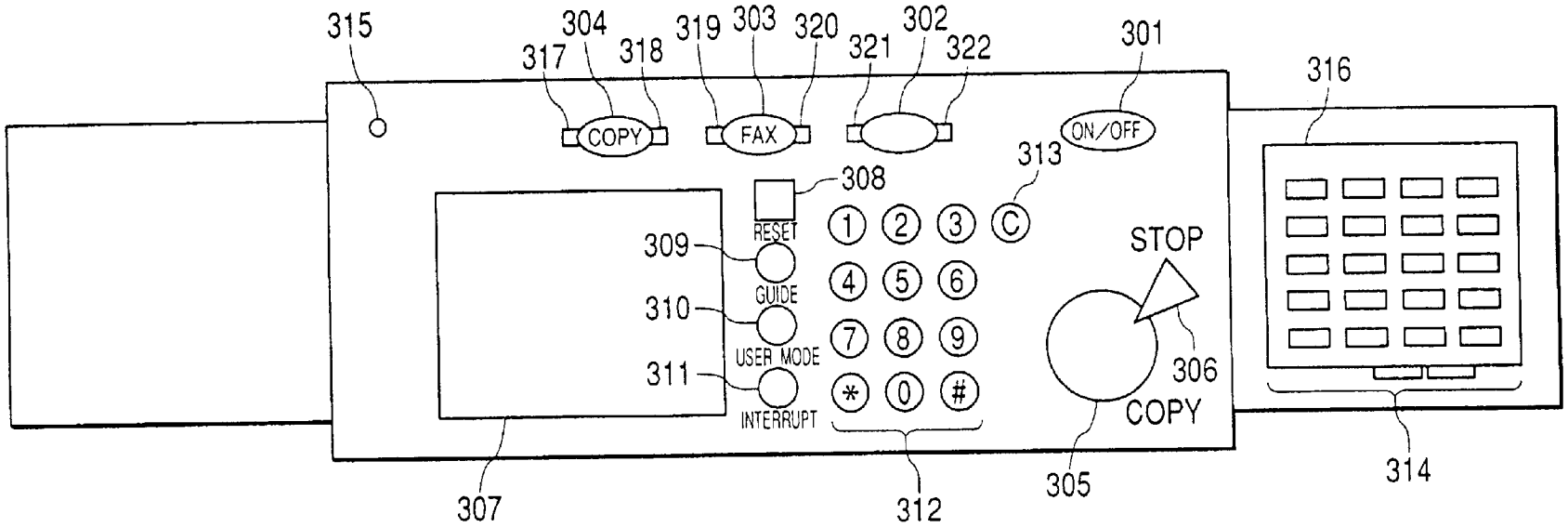
FIG. 4 is a pictorial view of the operating portion of the image forming apparatus according to the present invention.

FIG. 4 shows an example of the key arrangement on the operating portion of the digital copying machine (image forming apparatus) shown in FIG. 1. In FIG. 4, the reference numeral 301 designates a pre-heating key used for ON and OFF of the pre-heating mode, the reference numeral 302 denotes an option key used to select the option mode from among a plurality of functions when the option device of a printer or the like is used, the reference numeral 303 designates a FAX mode key used to select the FAX mode from among the plurality of functions, and the reference numeral 304 denotes a copy mode key used to select the copy mode from among the plurality of functions.

The reference numeral 305 designates a copy start key used to instruct to start copying, the reference numeral 306 denotes a stop key used to suspend or stop copying, and the reference numeral 307 designates a touch panel including liquid crystal and a touch sensor used to indicate an individual set image plane for each mode and to effect various kinds of detailed setting by the utilization of a depicted key.

Further, the reference numeral 308 denotes a reset key used to reset the mode to the standard mode during standby, the reference numeral 309 designates a guide key used when it is desired to know each function of the apparatus, the reference numeral 310 denotes a user mode key used when the user changes the basic setting of the system, the reference numeral 311 designates an interrupt key used when it is desired to effect interruption during copying to thereby effect copying, the reference numeral 312 denotes a ten-key used to input a numerical value, and the reference numeral 313 designates a clear key used when it is desired to clear the numerical value.

Furthermore, the reference numeral 314 denotes twenty one-touch dial keys used to dial by one touch in case of facsimile transmission. These one-touch dial keys 314 are of the shape of a dual lid having its key portions hollowed out, and detect a first state in which two lids 316 are closed, a second state in which only the first lid is opened, and a third state in which the two lids are opened. The operation of the one-touch dial keys 314 is determined by these three kinds of states of the lids in combination with the keys, and in the present embodiment, the keys 314 have the same function as that when there are 20×3=60 keys.

Still further, the reference numeral 315 designates a main power source lamp adapted to be turned on when a power source is ON, and the reference numerals 317 to 322 denote lamps for indicating statuses, and describing these lamps, the lamps 317 and 318 indicate the state during the copying operation, the lamps 319 and 320 indicate the state during the facsimile operation, and the lamps 321 and 322 indicate the state during the option operation. Also, the lamps 317, 319 and 321 indicate the state of a normal operation, and the lamps 318, 320 and 322 indicate the state of an error. Further, the lamp 317, if blinked, indicates that the copying operation is going on, and if turned on, indicates that an image memory is being used. The lamp 319, if blinked, indicates that facsimile transmission and reception is going on, and it turned on, indicates that the image memory is being used. The lamp 321, if blinked, indicates that data is being received, and if turned on, indicates that data is being transmitted. The lamps 318, 320 and 322, if blinked, indicate paper jam, the absence of paper or the absence of the toner, and if turned on, indicate the state of trouble, in each mode.

Recording Material Supplying Means

The recording material supplying means will now be described with reference to FIG. 1.

The recording material supplying means is provided with a plurality of recording material stacking portions for containing recording materials therein, and a recording material supplying portion for supplying the recording materials from those recording material stacking portions to the image forming means. The recording material stacking portions will first be described. As shown, recording material stacking portions 223 and 224 are disposed above and below, and another recording material stacking portion (not shown) is disposed below them.

These recording material stacking portions 223 and 224 are predetermined as to the kinds or the direction of stack of recording materials of standard sizes contained therein, and for example, the recording material stacking portion 223 is determined for A4 size, and the recording material stacking portion 224 is determined for A4R size. However, design may be made such that recording materials of a plurality of standard sizes or of the same size can be contained in different orientations in a recording material stacking portion.

When as in the former case, the kind or disposition of the recording materials is determined for each recording material stacking portion, the selection information of that recording material stacking portion can be used as recording material size detecting means. In the latter case, however, special recording material size detecting means is provided in a particular recording material stacking portion to detect the kind and orientation of recording materials contained therein. Such recording material size detecting means can be comprised, for example, of a position sensor for detecting the position of a recording-material-width regulating member provided in the recording material stacking portion. Recording material detecting means such as optical sensors (not shown) for detecting whether recording materials are contained are provided in the recording material stacking portions 223, 224, etc.

The recording material supplying portion is provided with lift-ups 225, 226, pairs of feed rollers 229, 230, 232, 233, 234, 235, and registration rollers 238. Also, when third and fourth recording material stacking portions (not shown) are installed, there are provided a pair of feed rollers 231 to be used to supply recording materials therein. Further, there are provided a manual feed tray 237 and a feed roller 236 to be used when the manual feed mode is selected on the operating portion.

The lift-ups 225 and 226 perform the operation of lifting up the recording materials contained in the recording material stacking portions 223 and 224 to the positions of the pairs of feed rollers 229 and 232. The pairs of feed rollers 229 and 232 are driven by a common driving motor (not shown) and selectively supplies the recording materials from one of the recording material stacking portions 223 and 224 by the changeover of the direction of rotation of the rollers. Also, each roller of the pairs of feed rollers 229 and 232 has torque applied thereto in a direction of rotation opposite to the feed direction to thereby prevent the double feed of the recording materials.

The pairs of feed rollers 230, 233, 234 and 235 serve to transport the recording materials from the recording material stacking portions 223 and 224 to the registration rollers 238. The registration rollers 238 supply the recording material to the transferring position, i.e., the position of the transfer charger 239, with the leading edge of the recording material timed with the leading edge of the toner image formed on the photosensitive member 240. A voltage is then applied to the transfer charger 239, whereby the developed image on the photosensitive member 240 is transferred onto the recording material.

Any toner residual on the photosensitive member 240 after the transfer to the recording material is removed by a cleaner 227. Generally the photosensitive member 240 is great in curvature and therefore it is easy for the recording material to be separated therefrom, but the separation of the recording material can be made easier by providing a charge eliminating needle 244 and weaking the attraction between the photosensitive member 240 and the recording material by the voltage of the charge eliminating needle 244.

The recording material separated from the photosensitive member 240 is transported to fixing means 30 by a transport belt 241. The fixing means 30 is provided with a heat roller (fixing roller) 213 and a pressure roller 214 opposed thereto, and the recording material has the toner thereon heated and pressurized and thereby fixed when it passes between the heat roller 213 as a heat member and the pressure roller 214. The details of the fixing means 30 will be described later.

The recording material discharged from the fixing means 30 is then transported toward a direction flapper 222 by a feed roller 215 comprising a combination of a large roller and two small rollers. At that time, the recording material has its curl corrected by the feed roller 215. The direction flapper 222 has the function of changing over the direction of the recording material in conformity with the operation mode set by the operating portion, and in a mode wherein recording is effected once on one side of the recording material (one-side recording), a path from the feed roller 212 toward a sheet discharge port is selected. That is, the recording material is guided by the direction flapper 222 and is discharged from a pair of sheet discharge rollers 216 to and stacked on a sheet discharge tray 242.

In the case of two-side recording, during the sheet discharging operation by the pair of sheet discharge rollers 216 after the termination of the fixation for one-side recording, the pair of sheet discharge rollers 216 are reversely rotated with the trailing edge of the recording material left therebetween. Together therewith, the direction of the direction flapper 222 is changed over to thereby cause the recording material to pass below the direction flapper 222, and feed the recording material from the sheet discharge port to a feed roller 217. The feed roller 217 is constructed like the feed roller 215, and feeds the recording material to an intermediate tray 243 and also corrects the curl of the recording material. The recording material is then transported from the intermediate tray 243 to the aforementioned transfer position by the feed rollers 218, 219, 221 and 235 in the named order, and at the transfer position, transfer to the back side of the recording material is effected, whereafter the thus transferred image is fixed and the recording material is discharged to the sheet discharge tray 242.

In the case of multi-recording, the recording material which has passed the feed roller 215 passes the right side of the direction flapper 222 as viewed in FIG. 1 by the changeover of the direction flapper 222, and is fed to the feed roller 217. The feed roller 217 feeds the recording material to the intermediate tray 243. Thereafter, the recording material is transported from the intermediate tray 243 to the aforementioned transfer position by the feed rollers 218, 219, 221 and 235 in the named order, and at the transfer position, transfer is effected again to the same side of the recording material as the side to which the last transfer has been effected.

Figure 3:
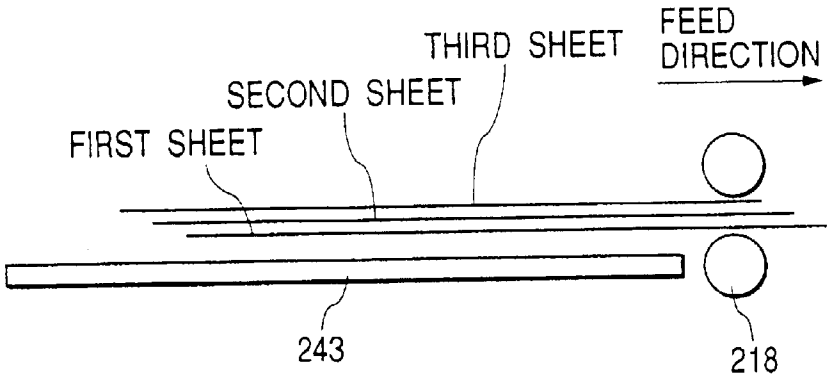
FIG. 3 illustrates the state of recording materials in a feed roller 218 portion in FIG. 1.

In both of two-side recording and multi-recording, when recording on a plurality of sheets is to be effected, the first recording material is stacked on the intermediate tray 243 while it is nipped and fixed between the feed rollers 218. When the second recording material arrives at the intermediate tray 243, the feed rollers 218 are rotated a little to thereby nip the second recording material therebetween, and in that state, the second recording material is stacked on the intermediate tray 243. The third and subsequent recording materials are stacked on the intermediate tray 243 in the same manner. In that case, the recording materials are stacked with the leading edges of the recording materials stacked later being deviated rearwardly with respect to the feed direction, as shown in FIG. 3.

When the number of recording materials set by the operating portion are stacked on the intermediate tray 243, the feeding of the recording materials from the intermediate tray 243 toward the downstream side is started. That is, the recording materials on the intermediate tray 243 are first fed from the feed rollers 218 and 219 to the feed roller 221, and in the course, a separation lever 220 is lowered to between the leading edges of the first and second recording materials, and only the first recording material is fed to the feed roller 221, and then the first recording material is transported to the transfer position, where transfer is effected thereto. The second and subsequent recording materials ride onto the separation lever 220, and thereafter are returned to the intermediate tray 243 by the reverse rotation of the feed rollers 218 and 219. Thereafter, similar operations are repeated, whereby all of the recording materials stacked on the intermediate tray 243 are transported one by one to the transfer position.

Sensors for detecting the recording material are disposed at various places in the transport path of the recording material and are used to detect an error such as a sheet jam, and contrive the operation timing of each portion. A first sensor 250 is disposed short of the feed rollers 235, a second sensor 251 is disposed short of the registration rollers 238, a third sensor 252 is disposed short of the feed rollers 215, a fourth sensor 253 is disposed between the pair of sheet discharge rollers 216 and the sheet discharged port, a fifth sensor 254 is disposed immediately behind the feed roller 217, and a sixth sensor 255 is disposed short of the separation lever 220.

The selection of the recording materials is effected by the following methods.

First, there is a method whereby the user himself selects the recording materials by the operating portion. Also, when in the operating portion, the mode is the automatic selecting mode for the recording materials, the following method is used. When an original is fed from the ADF onto the original stand or when an original is directly placed on the original stand, the size of the original is detected. This original size detection is effected by a plurality of sensors (not shown) provided below the original stand or the optical scanning or the like of image reading means. Here, together with the size of the original, in which of the lengthwise direction and the breadthwise direction the original has been set is judged. A recording material corresponding to the size of the original detected by this procedure is selected from the recording material stacking portion.

Fixing Means

Figure 5:
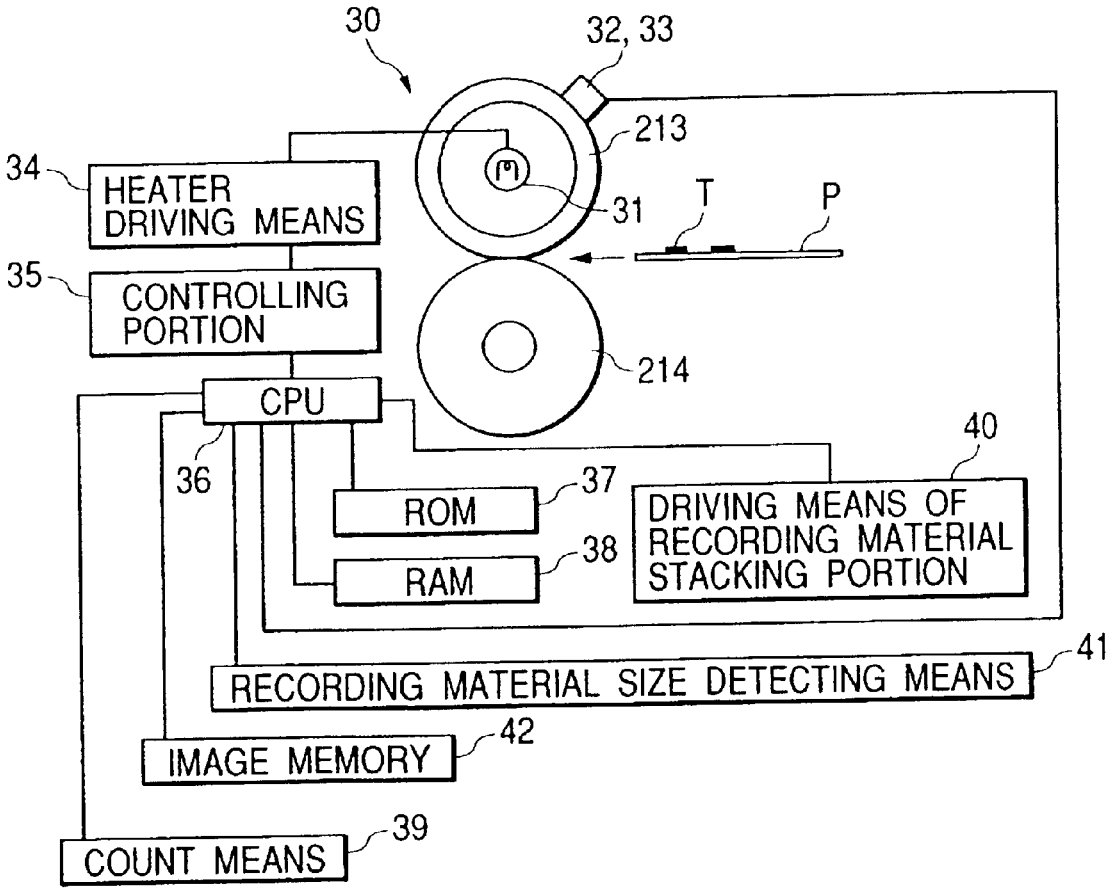
FIG. 5 is a block diagram of the fixing means 30 of the image forming apparatus according to the present invention.
Figure 6A:
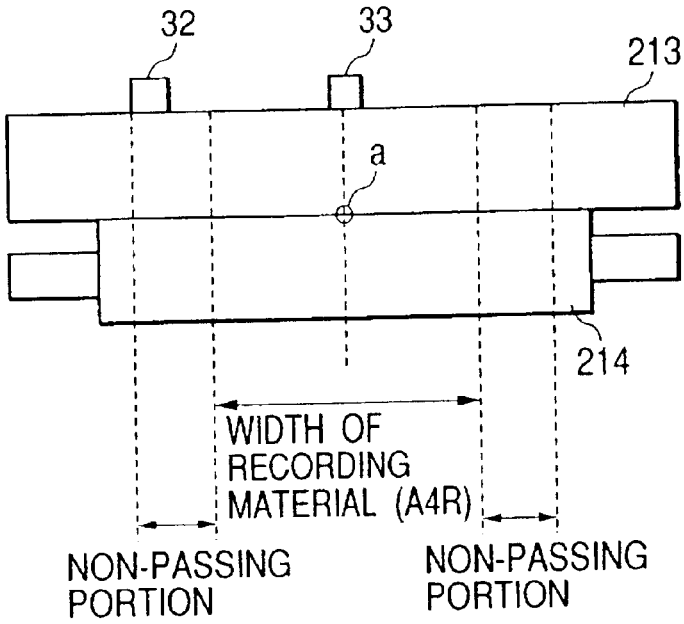
FIGS. 6A and 6B are front views of a heat roller 213 and a pressure roller 214 in FIG. 5.
Figure 6B:
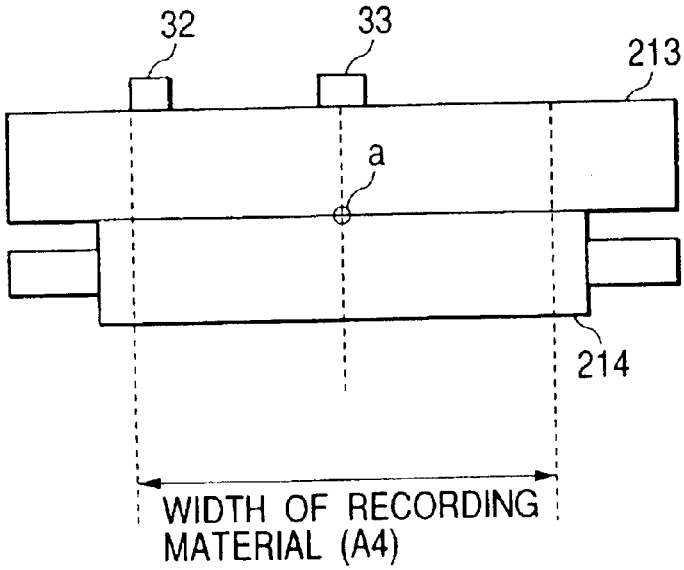

FIG. 5 is a block diagram of the fixing means 30, and FIGS. 6A and 6B are front views of the heat roller 213 as a heat member and the pressure roller 214 portion constituting the fixing means 30. The heat roller 213 and the pressure roller 214 are ones shown in FIG. 1.

In these figures, the reference numeral 31 designates a heater such as an elongate halogen lamp, the reference numerals 33 and 32 denote first and second temperature detecting elements such as thermistors which are temperature detecting means, the reference numeral 34 designates heater driving means such as a thyristor, the reference numeral 35 denotes a controlling portion such as a power amplifier, the reference numeral 36 designates a CPU (central processing unit), the reference numeral 37 denotes a ROM (read only memory), the reference numeral 38 designates a RAM (random access memory), the reference numeral 39 denotes count means, the reference numeral 40 designates the driving means of the recording material stacking portion, the reference numeral 41 denotes recording material size detecting means, the reference numeral 42 designates an image memory, the letter P denotes the recording material, and the letter T designates the toner transferred to the surface of the recording material P.

The CPU 36, the ROM 37, the RAM 38, the count means 39 and the driving means 40 of the recording material stacking portion are constituted by a microcomputer device, and the controlling portion 35 is controlled by detection signals from the first temperature detecting element 33 and the second temperature detecting element 32 to thereby control the temperature of the heat roller 213, and the changeover control of the recording material stacking portion is effected in the driving means 40 by a detection signal from the recording material size detecting means 41 or a count-up signal from the count means 39 and further, the control of the image memory 42 which is image storing means is effected.

In the present embodiment, an image memory which is volatile is used as the image storing means. The image memory temporarily stores therein an image signal from a signal processing portion constituting the exposing portion shown in FIG. 1 in an image plane unit, and is used to cause a latent image to be formed on the photosensitive member with an image rotated by 90 degrees in case of the changeover of the recording material size as will be described later.

The above-described control is executed by programs pre-stored in the ROM 37, the RAM 38, etc., and the operation sequence thereof will be described later. The microcomputer device is provided in common in the image forming apparatus, and is adapted to effect also the control of the other means than the fixing means 30.

The heat roller 213 comprises an elongate metal core comprising a cylinder made of a metal such as aluminum or iron and a mold release layer such as PFA or PTFE provided on the surface of the metal core, and has e.g. an outer diameter of 18 mm and a wall thickness of 1.8 mm. A heater 31 is mounted in the metal core. The pressure roller 214 is a backup member for pressurizing the recording material P passing between it and the heat roller 213. The heat roller 213 and the pressure roller 214 are driven by common driving means (not shown).

The first temperature detecting element 33 and the second temperature detecting element 32 are disposed on the surface of the heat roller 213 with their detecting portions being in contact with each other. As shown in FIGS. 6A and 6B, the first temperature detecting element 33 detects the surface temperature of the central portion of the heat roller 213, and the second temperature detecting element 32 detects the surface temperature of an end portion of the heat roller 213. The fixing means 30 according to the present invention adopts the so-called center reference construction in which irrespective of the size and direction of the recording material, the center of the recording material passes the center reference position "a" of the heat roller 213.

FIG. 6A shows the positional relation among the recording material P, the first temperature detecting element 33 and the second temperature detecting element 32 when an A4-sized recording material P is oriented in the lengthwise direction and supplied as A4R size, and FIG. 6B shows a similar relation when the A4-sized recording material is oriented in the breadthwise direction and supplied intactly. In the case of the A4R-sized recording material, the first temperature detecting element 33 is located in the passing portion and the second temperature detecting element 32 is located in the non-passing portion. Also, in the case of the A4-sized recording material, both of the first temperature detecting element 33 and the second temperature detecting element 32 are located in the passing portion. The case of an A3-sized recording material is similar to the case of the A4-sized recording material.

To achieve the lower cost and downsizing of the fixing means 30, it is necessary to minimize the outer diameters of the heat roller 213 and the pressure roller 214, and in the present embodiment, their outer diameters are made as small as the order of 18 mm, as described above. However, when these outer diameters are made as small as the order of 18 mm, the nip formed by the two rollers becomes as small as the order of 2 mm, and the energy given to the recording material P becomes considerably low.

Also, to enhance the efficiency of the apparatus, it is necessary to enhance the process speed (the peripheral speed of the photosensitive member 240) $V_p$ and the throughput of the recording material (the number of recording materials fed per one (1) minute). In the present embodiment, for example, high-speed recording can be effected at a process speed of 50 mm/second and a throughput of 8 pages/minute for A4-sized recording materials.

On the other hand, when the apparatus is started (risen up) and the heater 31, is driven, the surface temperature of the heat roller 213 gradually rises and reaches a normal temperature suited for fixing. However, it is desirable that the apparatus rising-time be as short as possible and for this purpose, the rising speed of the surface temperature of the heat roller 213 should be as great as possible.

To quickly start up the apparatus and secure a normal fixing property even in a low-temperature environment under the conditions of low nip and high-speed recording as mentioned above, it is desirable to set the surface temperature of the heat roller 213 immediately after the rising of the apparatus to a rather high level. When the surface temperature of the heat roller 213 is thus set to a rather high level, the pressure roller 214 also quickly rises in temperature and in a very short time after the apparatus has been risen, recording materials P can be continuously fed to the fixing means 30 to thereby start fixing. The control of the surface temperature of the heat roller 213 is effected by controlling the electrical energization frequency or the electrical energization ratio of the heater 31 by control means 35 shown in FIG. 5.

For example, when the surface temperature of the heat roller 213 is 180° C. during a normal operation, if the surface temperature is set to 200° C. at the rising of the apparatus, the recording materials P can be continuously fed to the fixing means 30 to thereby start fixing in a very short time even when the apparatus is started under an environment in which the room temperature is of the order of 15° C. Here, the expression that "the recording materials are continuously fed" means that a plurality of recording materials are fed simply by the user depressing a copy start button once.

Figure 7:
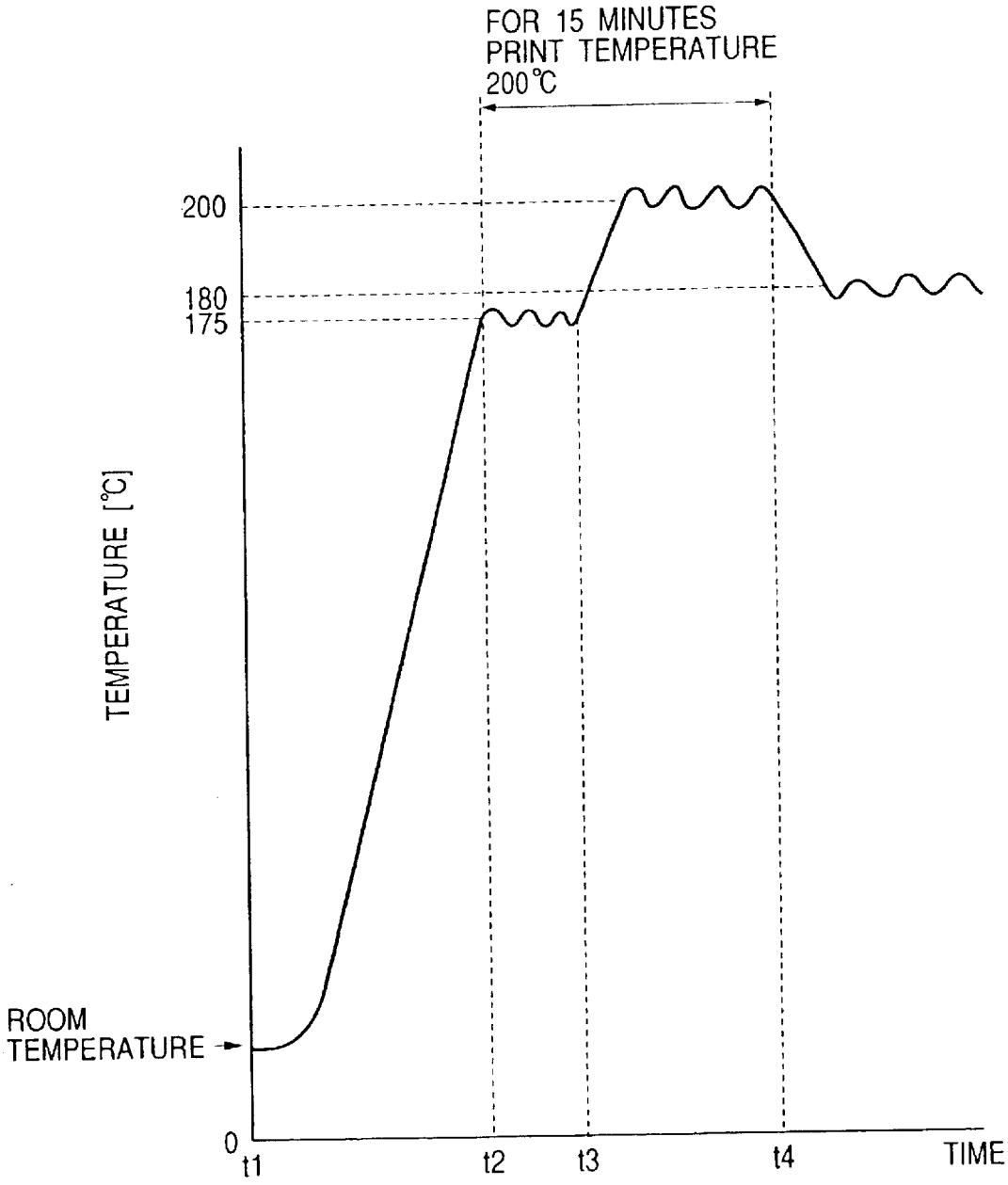
FIG. 7 shows temperature changes of the heat roller 213 at the start (rise time) of the image forming apparatus.

FIG. 7 shows an example of changes in the surface temperature of the heat roller 213 from immediately after the start of the apparatus until the apparatus reaches the normal operation. At a time t1, the power source of the apparatus is switched on to thereby start up the apparatus, and from a time t2 when the surface temperature of the heat roller 213 has reached 175° C., standby temperature control is effected. When this standby temperature control is continued for about 15 minutes, the apparatus reaches a state in which the pressure roller 214 also rises sufficiently in temperature and a stable fixing property is secured, but when a recording start button is depressed within 15 minutes, e.g. at a time t3, the surface temperature of the heat roller 213 is raised to 200° C., whereby the pressure roller 214 also rises quickly in temperature and reaches a stable fixing state and therefore, at that point of time, the fixing of the recording material is started.

At a time t4 when about 15 minutes has elapsed from the start-up of the apparatus, the pressure roller 214 also rises sufficiently in temperature and therefore, the surface temperature setting of the heat roller 213 is changed over from 200° C. to the temperature 180° C. during the normal operation. By effecting such temperature control, the temperature rise in the apparatus can be suppressed and yet the quick start-up of the apparatus can be effected even under a low-temperature environment.

Figure 8:
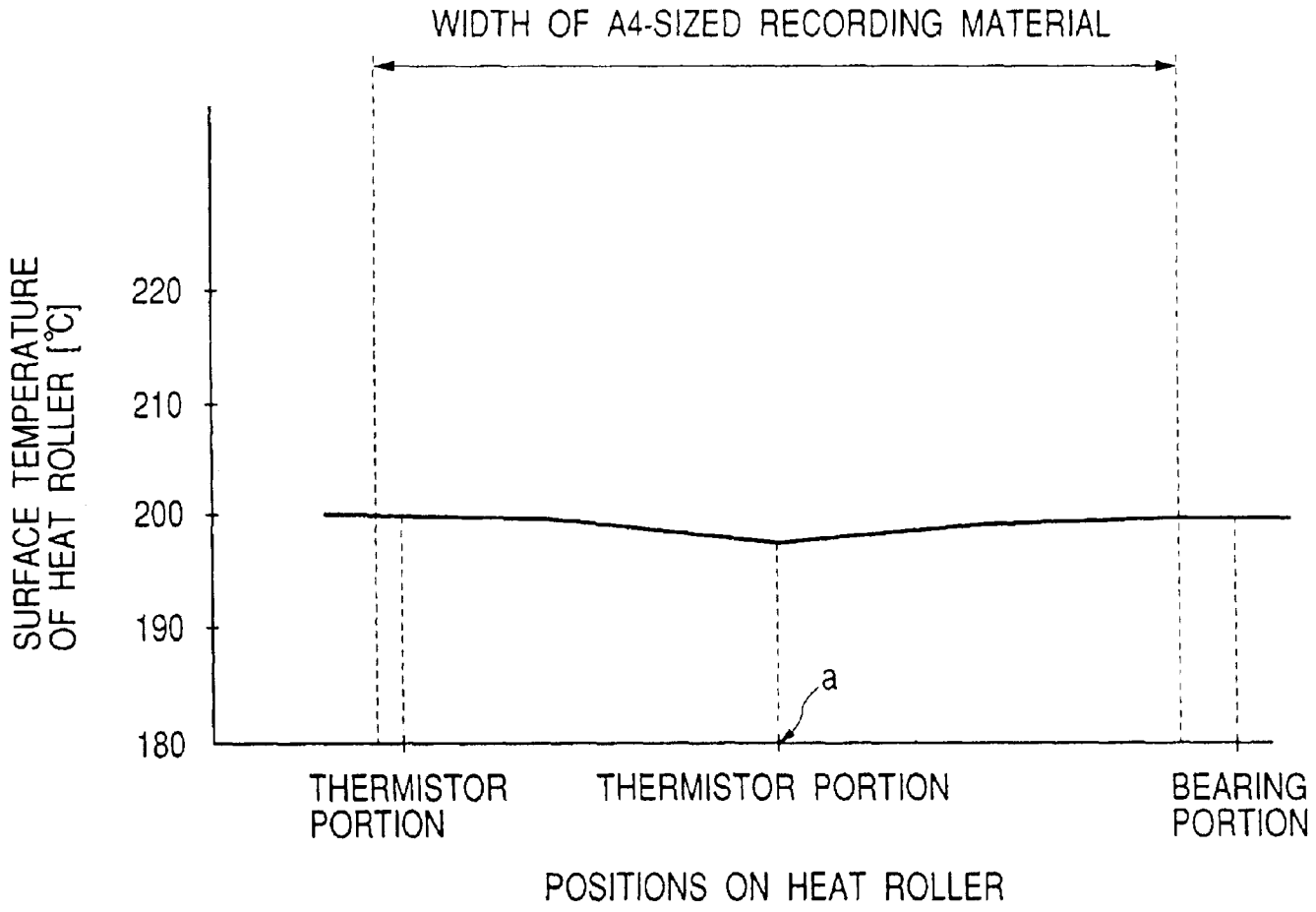
FIG. 8 shows the surface temperature distribution of the heat roller 213 when A4-sized recording materials are continuously recorded (outputted) with center reference.

FIG. 8 shows the surface temperature distribution of the heat roller 213 measured when in 15 minutes after the start-up of the apparatus, the surface temperature of the heat roller 213 was raised to 200° C. and A4-sized recording materials P were fixed at a speed corresponding to a throughput of 8 sheets/minute as will be seen from FIG. 8, when recording materials P of a great width are fixed, the surface temperature distribution of the heat roller 213 only slightly lowers near the center reference position "a" and becomes substantially flat. Therefore, the temperature of the bearing portions at the opposite end portions of the heat roller 213 nor exceeds the vicinity of 200° C.

Figure 9:
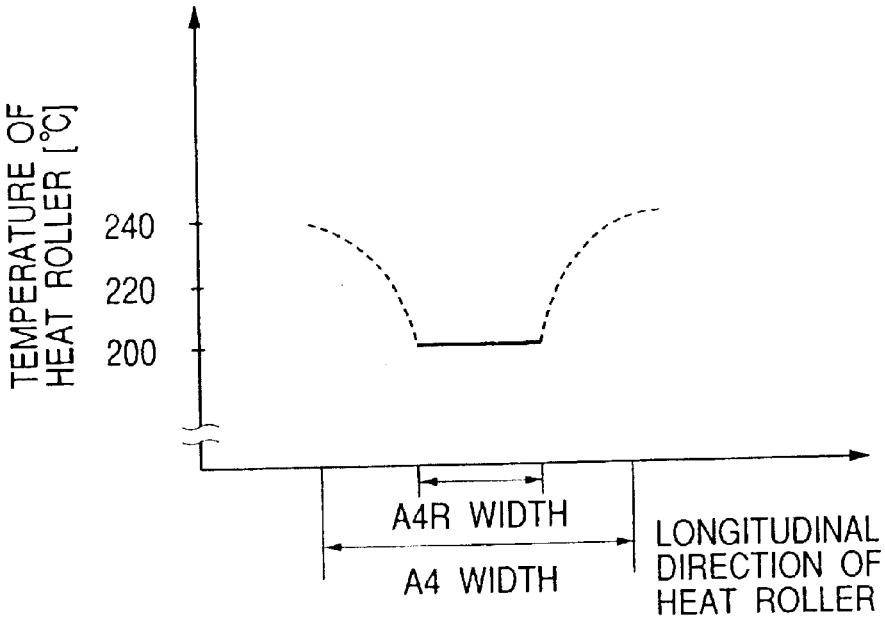
FIG. 9 shows the surface temperature distribution of the heat roller 213 when A4R-sized recording materials are continuously recorded (outputted) with center reference.

FIG. 9 shows the surface temperature distribution of the heat roller 213 when recording materials of a lengthwise size like A4R were likewise fixed at the center reference. In this case, the non-passing portions at the opposite ends of the heat roller 213 do not have their heat taken by the recording materials P and therefore rise in temperature to the vicinity of 240° C. beyond 200° C.

Figure 10:
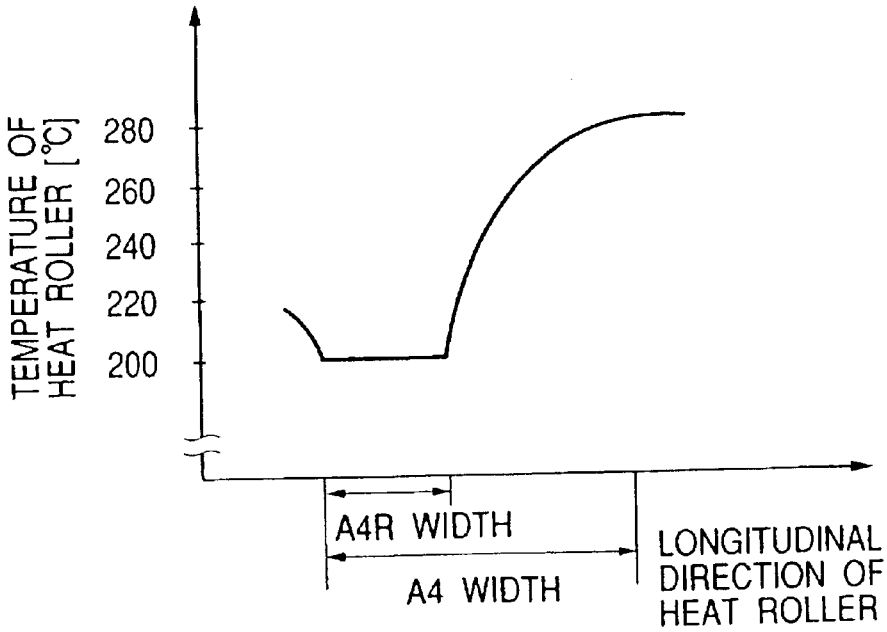
FIG. 10 is a reference graph showing the surface temperature distribution of the heat roller 213 when A4R-sized recording materials are continuously recorded (outputted) with end reference.

FIG. 10 shows, for reference, the surface temperature distribution of the heat roller 213 when A4R-sized recording materials were likewise fixed at the end reference. In this case, the non-passing portion at one end of the heat roller 213 does not have its heat taken by the recording materials P and therefore rises in temperature to the vicinity of 280° C. beyond 200° C.

Figure 11A:
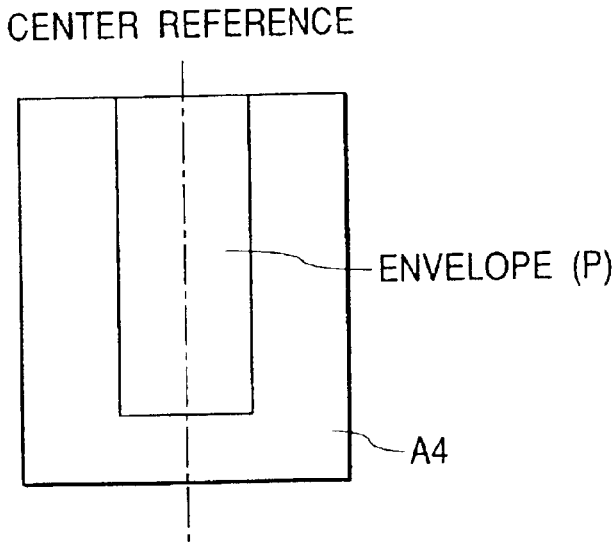
FIGS. 11A and 11B show the surface temperature distributions of the heat roller 213 when envelope-sized recording materials are continuously recorded (outputted) with center reference and end reference, respectively.
Figure 11B:
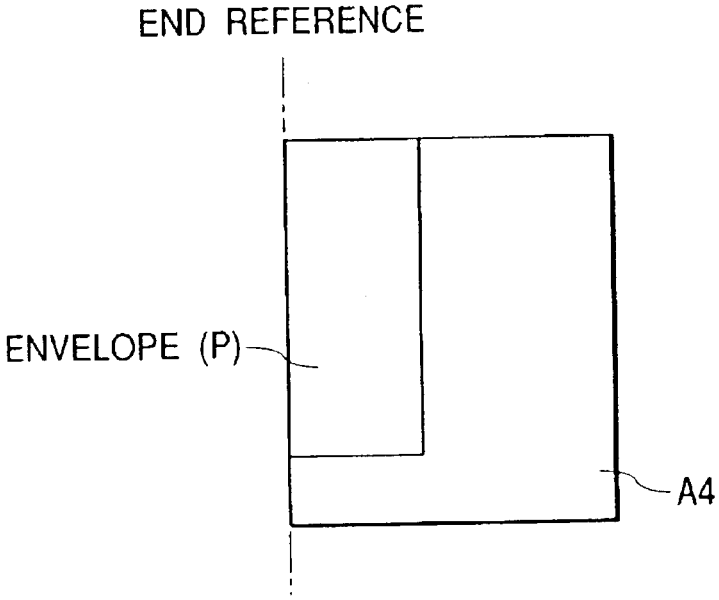

Further, FIG. 11A shows a case where a recording material P of envelope size is fed in the lengthwise direction at the center reference and is fixed, and FIG. 11B shows a case where it is fed in the lengthwise direction at the end reference and is fixed. The surface temperature distribution of the heat roller 213 in the case of FIG. 11A assumes a tendency similar to that of FIG. 9, and the surface temperature distribution of the heat roller 213 in the case of FIG. 11B assumes a tendency similar to that of FIG. 10.

As the bearings of the heat roller 213, use is usually made of bearings made of PPS (polyphenylene sulfide) resin as a base, and the heat-resisting temperature thereof is in the vicinity of 230° C. Therefore, when the apparatus is operated with the surface temperature of the heat roller 213 set to 200° C. as previously described, if for example, A4R-sized recording materials are continuously fed and fixed, the temperature of the bearing portions will rise to the vicinity of 240° C. beyond 230° C. which is the heat-resisting temperature, as shown in FIG. 9, and this is not preferable. When likewise, an envelope-sized recording material P is fed in the lengthwise direction at the center reference and fixed as shown in FIG. 11A, a similar problem will arise.

When the surface temperature of the end portions of the heat roller 213 rises as described above, a temperature gradient occurs between the central portion and the end portions of the heat roller, and the movement of heat energy from the end portions of a high temperature to the central portion of a low temperature occurs so that the temperature gradient may become small. However, when the recording materials are fed at a high speed, heat energy supplied from the heater 31 is greater than the moving heat energy and therefore, heat energy is accumulated in the non-passing portion of the heat roller 213 and this portion assumes a high temperature as previously mentioned.

The temperature detecting elements 32 and 33 effect temperature detection with their detecting portions being in contact with the surface of the heat roller 213, but the heat roller 213 is heated from its interior by the heater 31 and therefore, the temperature of the inside thereof usually becomes higher than the surface temperature thereof. This is a more severe condition to the bearings and also, the loss of heat energy, i.e., the loss of electric power, from the vicinity thereof becomes great.

As a method of avoiding such a problem, it would occur to mind to decrease the heat energy from the heater 31 more than the movement of the heat energy in order to decrease, for example, the temperature difference between the passing portion and the non-passing portion. To decrease the heat energy from the heater 31, the electrical energization frequency of the heater 31 can be decreased to thereby suppress the amount of generated heat or the throughput can be reduced. However, if the amount of generated heat is suppressed, it will affect the fixing property at the start-up of the apparatus, and if the throughput is reduced, there will arise another problem that the processing ability of the apparatus lowers.

Figure 12:
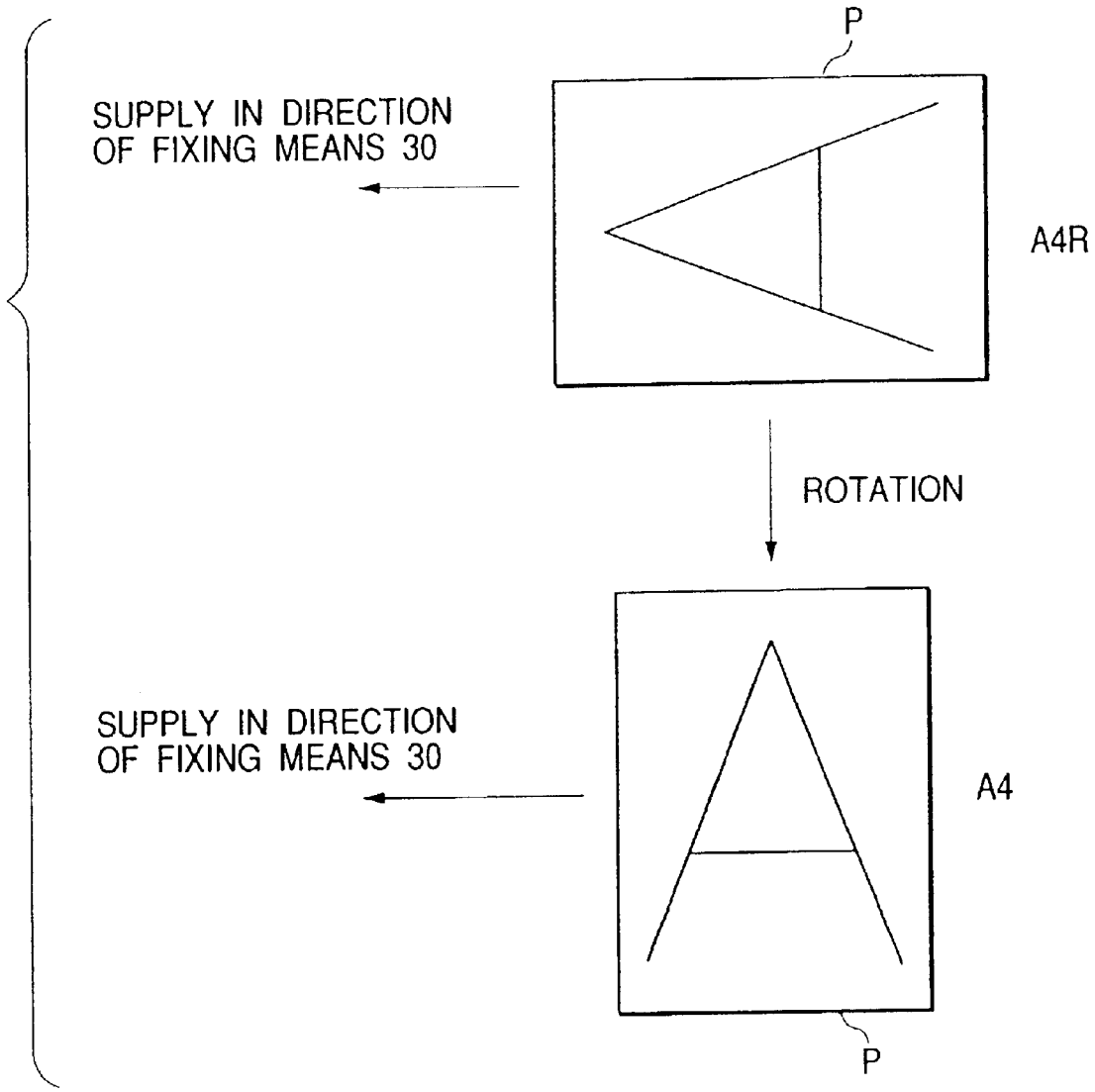
FIG. 12 illustrates the manner in which an A4R-sized recording material is turned by 90 degrees and is supplied as an A4-sized recording material to the fixing means 30.

So, in the present embodiment, when as shown in FIG. 12, recording is being effected on a recording material of which the longer side is the passing direction, e.g. at A4R size, if the temperature difference between the temperature detecting element 32 for detecting the temperature of the non-passing portion and the temperature detecting element 33 for detecting the temperature of the passing portion exceeds a preset value, the CPU 36 (FIG. 5) constituting the control means effects the control (changeover mode) of changing over the supply of the recording materials P from the recording material stacking portion containing therein recording materials at A4R size to the recording material stacking portion containing therein recording materials of which the shorter size is the passing direction, e.g. at A4 size, and rotating the image by 90 degrees.

Also when it is required to pass an envelope-sized recording material P so that the longer side thereof may be the passing direction and record on it, it is changed over to a recording material of the same size passed in such a manner that the shorter side thereof is the passing direction and control similar to that described above is effected to thereby effect fixing. By such control, the surface temperature distribution of the heat roller 213 becomes flat as shown in FIG. 8, and useless consumption of heat energy can be suppressed and the protection of the bearing portions of the heat roller 213 can be accomplished.

Figure 13:
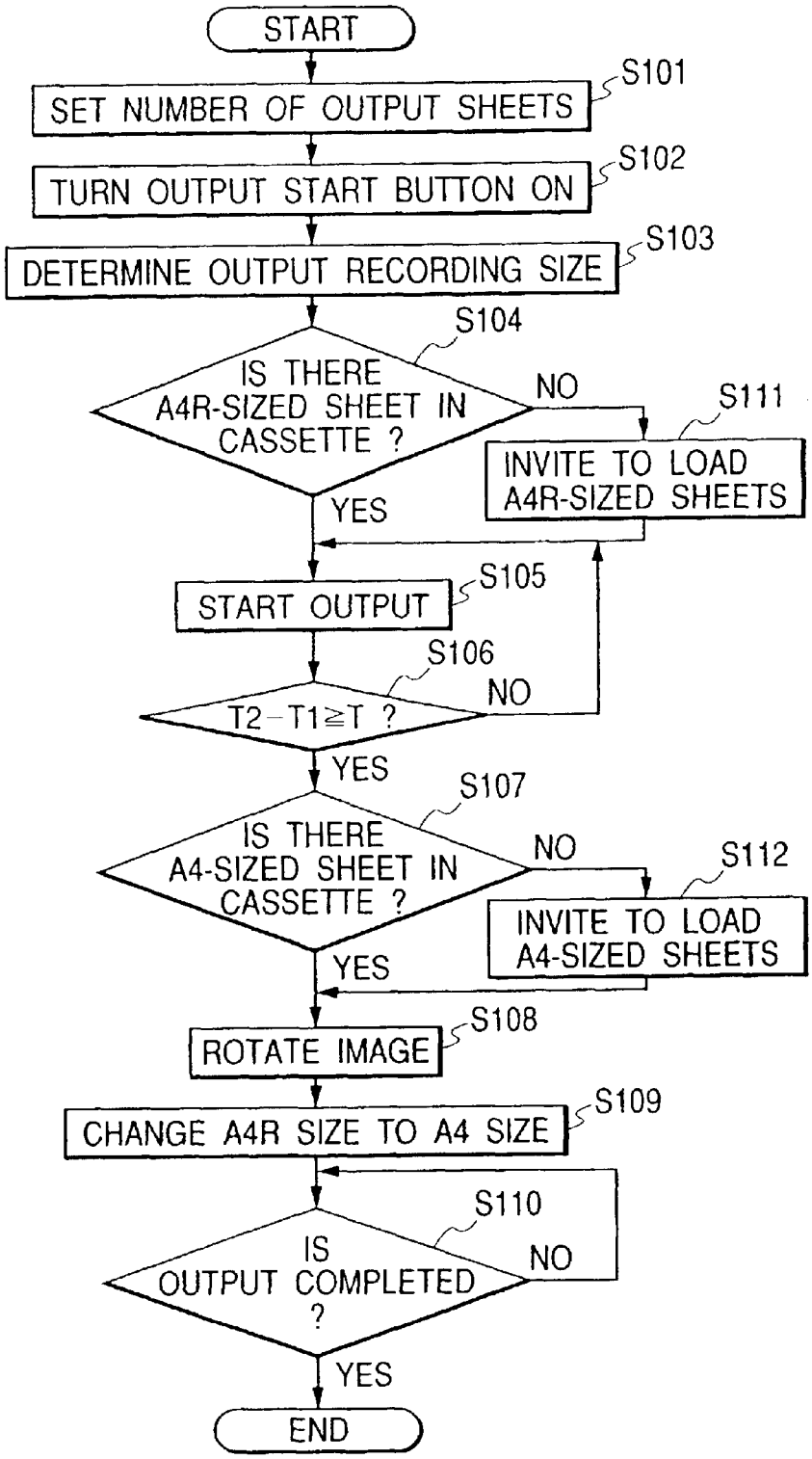
FIG. 13 is a flowchart of executing a sequence according to a first embodiment of the present invention.

FIG. 13 is a flowchart of executing the above-described processing sequence. When in the operating portion shown in FIG. 4, at a step S101 (hereinafter simply referred to as S101), the operator sets the number of output (record) sheets and depresses the copy start key 305 (S102), the size of recording materials to be outputted is determined (S103). It is to be understood here that A4R-sized recording materials are outputted.

Next, whether recording materials are contained in the selected recording material stacking portion is judged on the basis of a detection signal from the recording material detecting means (S104), and if they are contained, the outputting (supply) of the recording materials is started from the associated recording material stacking portion (S105), and if they are not contained, a message for inviting an operator to load the associated recording material stacking portion with A4R-sized recording materials is indicated to the operating portion of FIG. 4, and after at S111, the loading of the recording materials is executed, shift is made to the operation of S105.

Next, whether the difference between the temperatures detected by the first temperature detecting element 33 and the second temperature detecting element 32 during the continuous outputting operation has become equal to or greater than a first temperature difference value T° C. is judged (S106), and if it has not reached T° C., the outputting is continued. If it has become equal to or greater than T° C., whether recording materials are contained in the recording material stacking portion for containing A4-sized recording materials therein is judged (S107), and if they are contained, an image for which a latent image is to be formed next on the photosensitive member 240 is stored in the image memory 42 (FIG. 5) and it is rotated by 90 degrees and outputted (S108), and if they are not contained, a message for inviting an operator to load the associated recording material stacking portion with A4-sized recording materials is indicated to the operating portion of FIG. 4, and after the loading of the recording materials is executed at S112, shift is made to the operation of S108.

Then the outputting of the recording material is changed over from the A4R-sized recording material stacking portion to the A4-sized recording material stacking portion (S109), and further, whether the outputting of a set number of sheets has been completed is judged (S110), and if it has been completed, the processing sequence is ended.

Figure 14:
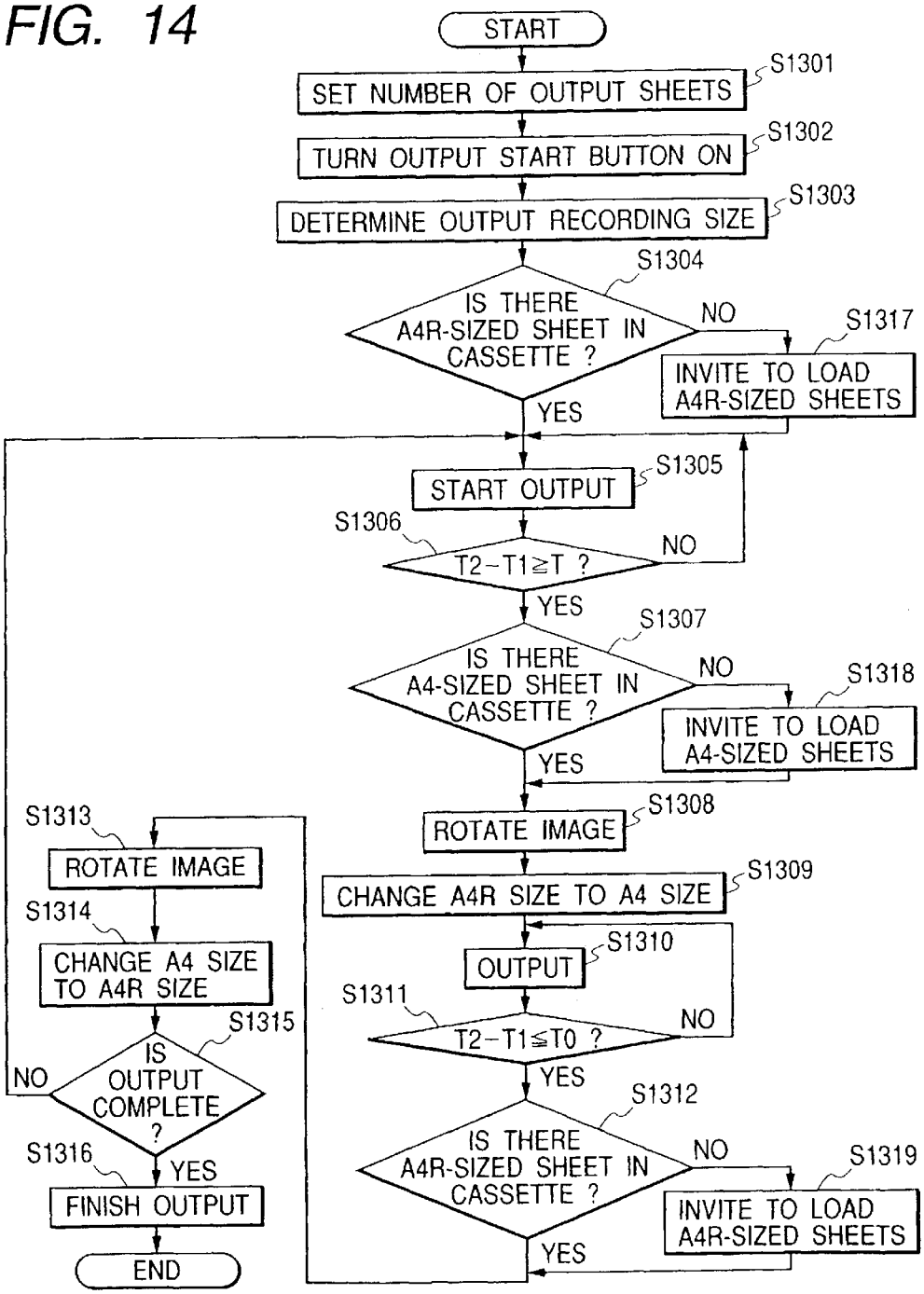
FIG. 14 is a flowchart of executing a sequence according to a second embodiment of the present invention.

FIG. 14 is a flowchart of the sequence of executing the recording material changeover processing according to a second embodiment. In the first embodiment, when the difference between the temperatures detected by the first temperature detecting element 33 and the second temperature detecting element 32 has become equal to or greater than the preset first temperature difference value T° C., the changeover processing of the recording material stacking portion is effected, and that state is continued until the outputting of a set number of sheets is completed. The second embodiment, however, is characterized in that when after the above-described changeover, the temperature difference has become smaller than a discretely set second temperature difference value T0° C. (T0 <T), the operation of returning it to the original recording material stacking portion to output the recording material from the original recording material stacking portion is performed, and thereafter the series of operations are repeated.

In the operating portion shown in FIG. 4, at S1301, the operator sets the number of output (record) sheets and depresses the copy start key 305 (S1302), whereupon the size of outputted recording materials is determined (S1303). It is to be understood here that A4R-sized recording materials are outputted.

Next, whether recording materials are contained in the selected recording material stacking portion is judged on the basis of the detection signal from the recording material detecting means (S1304), and if they are contained, the outputting (supply) of the recording materials is started from the associated recording material stacking portion (S1305), and if they are not contained, a message for inviting an operator to load the associated recording material stacking portion with A4R-sized recording materials is indicated to the operating portion of FIG. 4, and after the loading of the recording materials is executed at S1317, shift is made to the operation of S1305.

Next, whether the difference between the temperatures detected by the first temperature detecting element 33 and the second temperature detecting element 32 during the continuous outputting operation has become equal to or greater than preset T° C. is judged (S1306), and if it has not reached T° C., the outputting is continued. If it has become equal to or greater than T° C., whether recording materials are contained in the recording material stacking portion for containing A4-sized recording materials therein is judged (S1307), and if they are contained, an image for which a latent image is to be formed next on the photosensitive member 240 is stored in the image memory 42 (FIG. 5) and it is rotated by 90 degrees and outputted (S1308), and if they are not contained, a message for inviting an operator to load the associated recording material stacking portion with A4-sized recording materials is indicated to the operating portion of FIG. 4, and after the loading of the recording materials is executed at S1318, shift is made to the operation of S1308.

Then, the outputting of the recording materials is changed over from the A4R-sized recording material stacking portion to the A4-sized recording material stacking portion (S1309), and the outputting is continued (S1310). Whether during the outputting, the above-mentioned temperature difference is always smaller than T0° C. is judged (S1311), and if it is not smaller, the outputting is continued, and if it has become smaller than T0° C., at S1312, whether recording materials are contained in the recording material stacking portion for containing A4R-sized recording materials therein is judged, and if they are contained, the image is rotated (S1313), and the supply of the recording materials is changed over from the recording material stacking portion for containing A4-sized recording materials therein to the recording material stacking portion for containing A4R-sized recording materials therein (S1314). Also, if they are not contained, a message for inviting an operator to load the associated recording material stacking portion with A4R-sized recording materials is indicated to the operating portion of FIG. 4, and after the loading of the recording materials is executed at S1319, shift is made to the operation of S1313.

Then, at S1315, whether the outputting of the set number of sheets has been completed is judged and if it has not been completed, return is made to S1305, where the above-described processing is repeated, and if it is judged that the outputting has been completed, the outputting is finished (Sl316), thus ending the sequence.

According to the second embodiment, in addition to the effect of the first embodiment, a particular recording material stacking portion is equalizedly used without inclination, and this leads to the effect that the loading of the recording materials is equalized.

Figure 15:
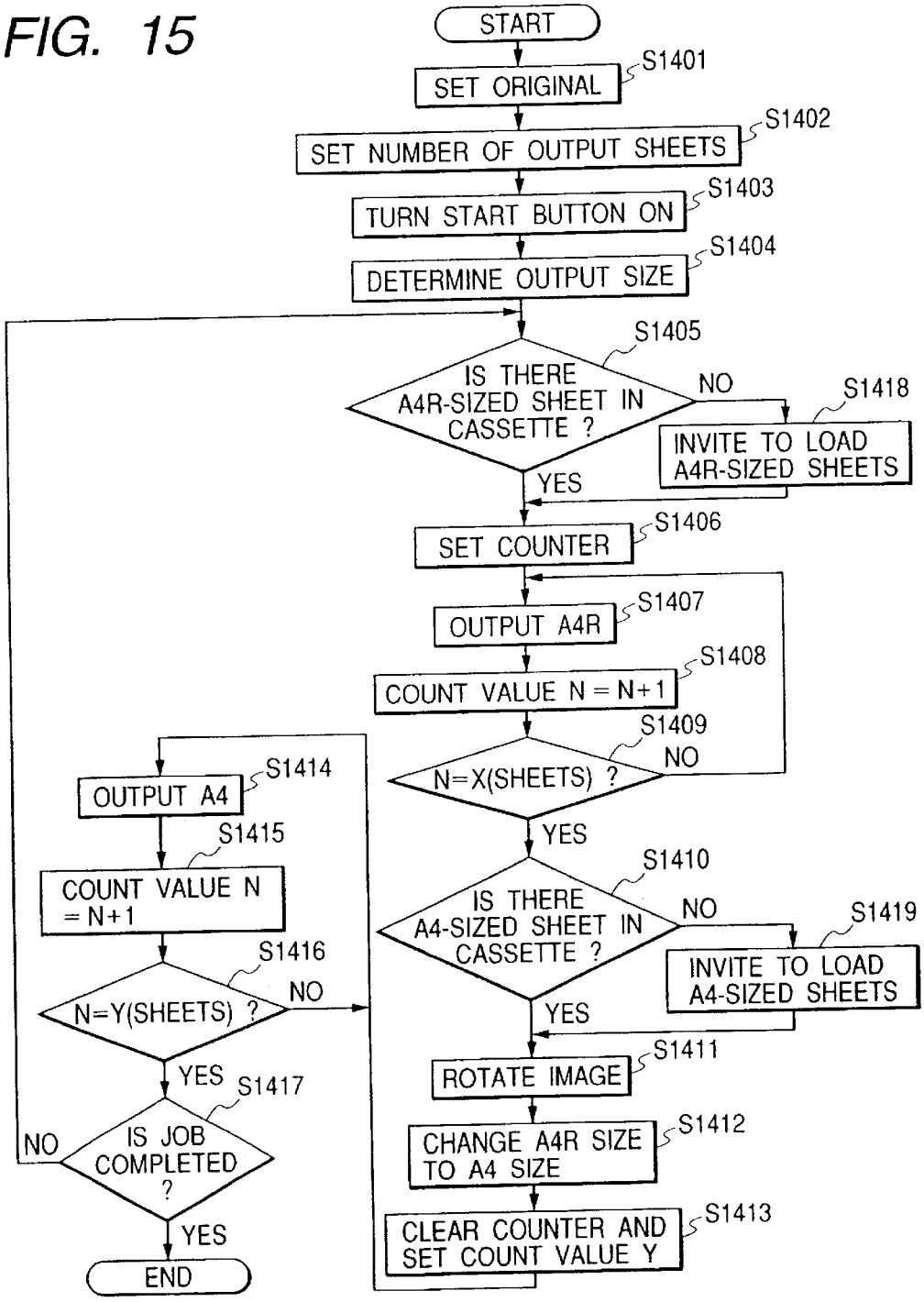
FIG. 15 is a flowchart of executing a sequence according to a third embodiment of the present invention.

FIG. 15 is a flowchart of the sequence of executing the recording material changeover processing according to a third embodiment. While in the first and second embodiments, the recording material stacking portion is changed over when the difference between the temperatures detected by the first temperature detecting element 33 and the second temperature detecting element 32 has become equal to or greater than the preset temperature difference value, the third embodiment is characterized in that the recording material stacking portion is changed over in conformity with the number of outputted recording materials.

As previously described, when A4R-sized recording materials are outputted at a speed corresponding to a throughput of 8 sheets/minute, the detected temperature of the recording material passing portion by the temperature detecting element 33 becomes lower than the detected temperature of the non-passing portion by the temperature detecting element 32. The movement of heat energy occurs from the end portion in which the surface temperature of the heat roller 213 is high to the central portion in which the surface temperature is low.

According to an experiment, however, it has been found that when in the course of the continuous outputting operation for recording materials of which the longer side is the passing direction (e.g. A4R-sized recording materials), recording materials having a great width (e.g. A4-sized recording materials) are intermittently outputted, the surface temperature of the heat roller 213 becomes flat as shown in FIG. 8. For example, even when a hundred (100) sheets of A4R-sized recording materials are to be continuously outputted, five (5) sheets of A4R-sized recording materials can be continuously outputted, whereafter fifteen (15) sheets of A4-sized recording materials can be outputted, and thereafter this processing can be repeated to thereby finish the outputting. The present embodiment is based on such a finding.

In this embodiment, description will be made of a case where image formation (recording process) is performed with the ADF of FIG. 2 mounted on the image forming apparatus of FIG. 1. First, the operator sets an original on the ADF (S1401), and then sets the number of output (record) sheets by the operating portion of FIG. 4 (S1402), and depresses the copy start key 305 (S1403), whereupon the size of the recording materials to be outputted is determined (S1404). It is to be understood here that A4R-sized recording materials are outputted.

Next, whether recording materials are contained in the selected recording material stacking portion is judged on the basis of the detection signal from the recording material detecting means (S1405), and if they are contained, the count means (hereinafter simply referred to as the counter) is set (S1406), and the outputting of A4R-sized recording materials is started (S1407). If A4R-sized recording materials are not contained, a message for inviting an operator to load the associated recording material stacking portion with A4R-sized recording materials is indicated to the operating portion of FIG. 4, and after the loading of the recording materials is executed at S1418, shift is made to S1406.

Each time a sheet of A4R-sized recording material is outputted, the counter is counted up (S1408), and at S1408, whether the count value N thereof has reached a preset first count value X is judged. The above-described outputting is continued until the count value N reaches the set value X. When the count value N reaches the first count value X, at S1410, whether recording materials are contained in the recording material stacking portion for containing A4-sized recording materials therein is judged, and if they are contained, an image for which a latent image is to be formed next on the photosensitive member 240 is stored in the image memory 42 (FIG. 5) and it is rotated by 90 degrees and outputted (S1411), and if they are not contained, a message for inviting an operator to load the associated recording material stacking portion with A4-sized recording materials is indicated to the operating portion of FIG. 4, and after the loading of the recording materials is executed at S1419, shift is made to the operation of S1411.

Then, the outputting of the recording materials is changed over from the A4R-sized recording material stacking portion to the A4-sized recording material stacking portion (S1412), and the outputting thereof is effected and also the counter is cleared and a second count value Y is set (S1413). Each time a sheet of A4-sized recording material is outputted, the counter is counted up (S1415), and at S1416, whether the count value N thereof has reached the preset second count value Y is judged. The above-described outputting is continued until the count value N reaches the second count value Y.

When the count value N reaches the second count value Y, at S1417, whether the outputting of the set number of sheets has been completed is judged, and if it has not been completed, return is made to S1405, where the above-described processing is repeated, and if it is judged that it has been completed, the outputting is completed, thus ending the sequence. The setting of the first count value and the setting of the second count value can also be effected by discrete count means.

Again by the third embodiment, the heat energy uselessly consumed by the heat roller 213 can be suppressed. Further, a particular recording material stacking portion is equalizedly used without inclination, and this leads to the effect that the loading of the recording materials is equalized.

While the present embodiment uses the ADF, a similar effect will of course be obtained even when the ADF is not used.

Figure 16:
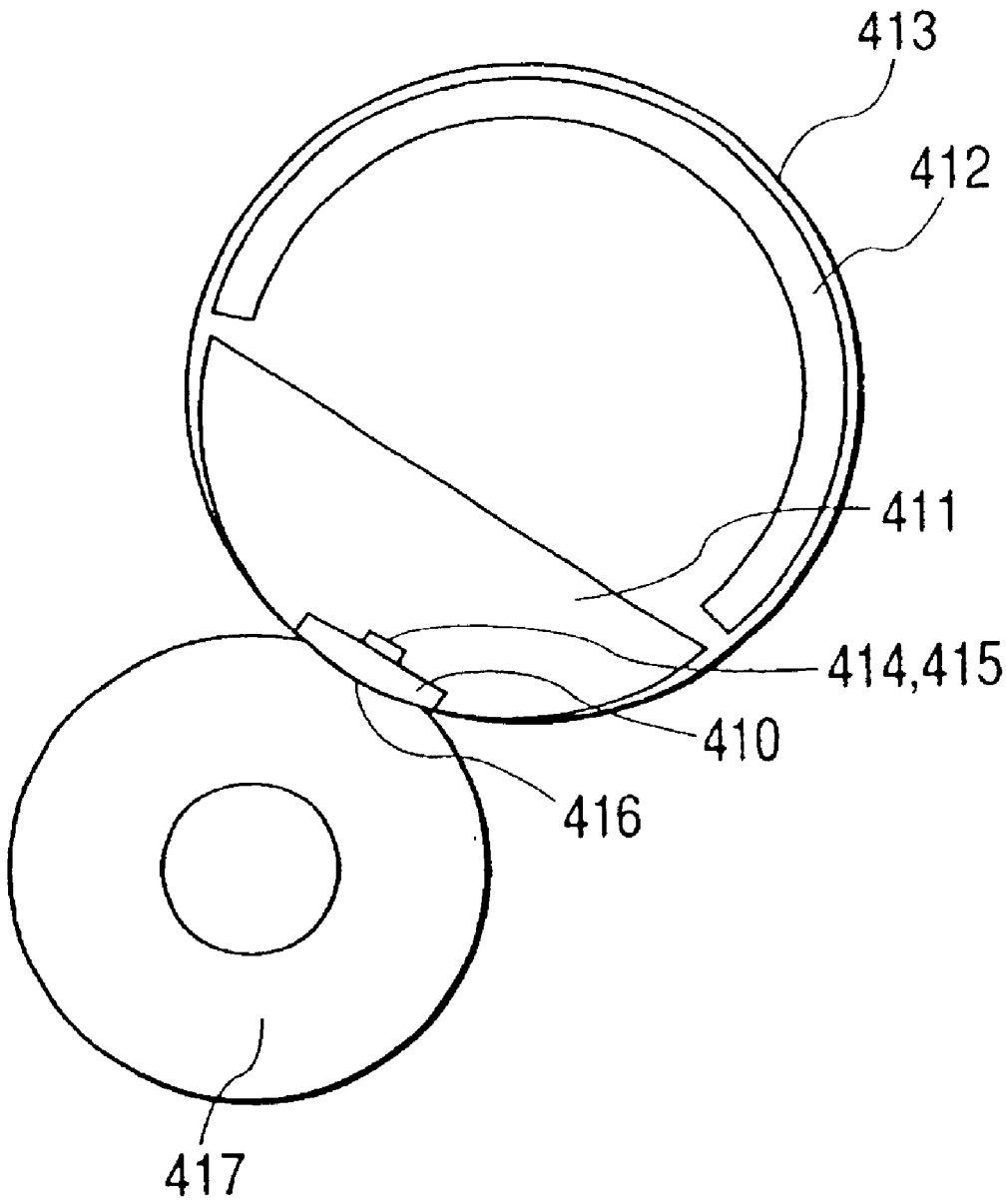
FIG. 16 is an illustration of a fixing device using fixing film.

While in the above-described embodiments, description has been made of a fixing device using a heat roller in the present embodiment, there is shown a fixing device using fixing film as shown in FIG. 16. A ceramic heater 410 is used as a heat member, and temperature detecting means 414 and 415 at the central portion and the end portion, respectively, are adhesively secured to the back of the heater 410, and the heater 410 is held by a heater holder 411 as a holding member. Further, the reference numeral 413 designates film made of PI and having a thickness of the order of 60 $\mu$m, and it forms a nip in such a manner as to be nipped between a pressure roller 417 and the heater 410.

Also, the reference numeral 412 designates the guide stay of a guide member for guiding the rotation of the film. In the present embodiment, the ceramic heater 410 as a heat member is low in heat capacity and directly heats the nip portion 416 through the PI film of only 60 $\mu$m, and this leads to the merit that the wait time during which fixing becomes possible is short.

Again in a fixing device using such fixing film, the temperature rise of the non-passing portion occurs and therefore, it is possible to apply the present invention thereto. Also, even if the present invention is used in such a fixing device, the effect of the present invention will be affected in no way.

A further embodiment will be shown below. The above-described embodiments are of a construction in which the image of an original is read and on the basis thereof, image formation is effected, but as shown below, the present invention can be applied even to a laser beam printer. The effect of the present invention will be affected in no way even in a construction wherein outputted image data is inputted to an image memory which is image storing means, whereafter on the basis of the inputted image data, images are continuously formed or images are intermittently formed.

As described above, in the image forming apparatus according to the present invention, even when it is required to effect continuous copying (recording) on recording materials having a narrow recording width, the heat energy of the non-passing portion of the heat roller in the fixing means can be efficiently consumed without the throughput being reduced and as a result, there can be constructed an energy-saving image forming apparatus. Also, even when image formation is effected again in a state in which the temperature of the end portions of the heat roller is very high as compared with the temperature of the central portion of the heat roller, the heat energy of such end portions can be utilized and therefore, there can be constructed an energy-saving image forming apparatus. Further, the higher temperature of the bearing portions at the end portions of the heat roller can be prevented to thereby lengthen the life of the bearings.

While the embodiments of the present invention have been described above and in the present embodiment, the recording materials have been described as A4 and A4R, the recording materials of these sizes are not restrictive, but it is possible to use recording materials of other sizes within the technical idea of the present invention. Also, the present invention is not restricted to the above-described embodiments, but all modifications are possible within the technical idea of the present invention.

What is claimed is:

1. An image forming apparatus comprising:

image forming means for forming an unfixed image on a recording material transported thereto, said image forming means being for continuously forming images on recording materials differing in width thereof in a direction orthogonal to a transport direction thereof;

fixing means having a heat member and for fixing the unfixed image by use of heat and pressure; and recording material changeover means, when images are to be continuously formed on recording materials smaller in the width thereof in the direction orthogonal to the transport direction than a maximum width with which the recording materials are allowed to be passed, for changing over the recording materials to recording materials greater in the width thereof in the direction orthogonal to the transport direction than the recording materials on which images are being formed during a continuous image formation.

2. An image forming apparatus according to claim 1, further comprising recording material supplying means having at least one recording material stacking portion.

3. An image forming apparatus according to claim 2, further comprising recording material detecting means for detecting a presence or absence of recording materials contained in said recording material stacking portion, wherein said recording material stacking portion in which the presence of the recording materials has been detected by said recording material detecting means is selected.

4. An image forming apparatus according to claim 3, wherein warning is given when said recording material detecting means of the recording material stacking portion to be selected does not detect the presence of the recording materials.

5. An image forming apparatus according to claim 1, further comprising recording material selecting means for selecting recording materials to be supplied from a plurality of recording material stacking portions, wherein during a changeover of the recording material, a recording material is selected from said recording material selecting means.

6. An image forming apparatus according to claim 1, further comprising size detecting means for detecting a size of a selected recording material, wherein during a changeover of the recording material, a recording material greater in the width thereof in the direction orthogonal to the transport direction than the width of the recording material in the direction orthogonal to the transport direction before the changeover is selected on the basis of said size detecting means.

7. An image forming apparatus according to claim 1, further comprising:

first temperature detecting means for detecting a surface temperature of the heat member in a position, through which a recording material having a minimum width in the direction orthogonal to the transport direction passes; and second temperature detecting means for detecting a surface temperature of the heat member in a position differing from the position of said first temperature detecting means, said changeover means being operated on the basis of said second temperature detecting means.

8. An image forming apparatus according to claim 7, wherein said changeover means is operated when a difference between the temperature detected by said first temperature detecting means and the temperature detected by said second temperature detecting means is equal to or greater than a predetermined value.

9. An image forming apparatus according to claim 7, comprising recording material re-changeover means for returning the recording material to the recording material before a changing-over operation, wherein said recording material re-changeover means is operated on the basis of said second temperature detecting means.

10. An image forming apparatus according to claim 7, comprising recording material re-changeover means for returning the recording material to the recording material before a changing-over operation, wherein said recording material re-changeover means is operated when a difference between the temperature detected by said first temperature detecting means and the temperature detected by said second temperature detecting means is equal to or smaller than a predetermined value.

11. An image forming apparatus according to claim 1, further comprising image rotating means for rotating a forming image orientation, wherein the forming image orientation is rotated through a predetermined angle in association with an operation of said changeover means.

12. An image forming apparatus according to claim 11, further comprising image storing means for storing an image to be output, wherein the forming image orientation of the image stored by said image storing means is rotated through the predetermined angle.

13. An image forming apparatus according to claim 11, wherein the forming image orientation is rotated through approximately 90 degrees.

14. An image forming apparatus according to claim 1, wherein in a changing-over operation by said changeover means, the recording material is changed over to a recording material of the same size as the recording material before the changeover rotated through a predetermined angle with respect to the transport direction.

15. An image forming apparatus according to claim 14, wherein the predetermined angle through which the recording material is rotated is approximately 90 degrees.

16. An image forming apparatus according to claim 1, further comprising count means for counting a number of recorded recording materials, wherein an operation of said changeover means is performed on the basis of a count value by said count means.

17. An image forming apparatus according to claim 1, comprising recording material re-changeover means for returning the recording material to the recording material before a changing-over operation.

18. An image forming apparatus according to claim 17, further comprising image rotating means for rotating a forming image orientation, wherein a forming image orientation is rotated through a predetermined angle by said image rotating means in association with an operation of said recording material re-changeover means.

19. An image forming apparatus according to claim 18, further comprising image storing means for storing an image to be output, wherein the forming image orientation of the image stored by said image storing means is rotated through the predetermined angle.

20. An image forming apparatus according to claim 18, wherein the forming image orientation is rotated through approximately 90 degrees.

21. An image forming apparatus according to claim 17, wherein in a changing-over operation by said re-changeover means, the recording material is changed over to a recording material of the same size as the recording material before the changeover rotated through a predetermined angle with respect to the transport direction.

22. An image forming apparatus according to claim 21, wherein the predetermined angle through which the recording material is rotated is approximately 90 degrees.

23. An image forming apparatus according to claim 17, further comprising count means for counting a number of recorded recording materials, wherein an operation of said recording material re-changeover means is performed on the basis of a count value by said count means.

24. An image forming apparatus comprising:

image forming means for forming an unfixed image on a recording material transported thereto, said image forming means being for forming images on the recording materials differing in width thereof in a direction orthogonal to a transport direction thereof;

fixing means having a heat member and for fixing the unfixed image by use of heat and pressure;

first temperature detecting means for detecting a surface temperature of the heat member in a position, through which a recording material having a minimum width in the direction orthogonal to the transport direction passes;

second temperature detecting means for detecting a surface temperature of the heat member in a position differing from the position of said first temperature detecting means; and recording material changeover means, when images are to be formed on recording materials smaller in the width thereof in the direction orthogonal to the transport direction than a maximum width, for changing over the recording materials to recording materials greater in the width thereof in the direction orthogonal to the transport direction than the recording materials on which images are being formed, on the basis of said second temperature detecting means.

25. An image forming apparatus according to claim 24, further comprising recording material supplying means having at least one recording material stacking portion.

26. An image forming apparatus according to claim 25, further comprising recording material detecting means for detecting a presence or absence of recording materials contained in said recording material stacking portion, wherein said recording material stacking portion in which the presence of the recording materials has been detected by said recording material detecting means is selected.

27. An image forming apparatus according to claim 26, wherein warning is given when said recording material detecting means of the recording material stacking portion to be selected does not detect the presence of the recording materials.

28. An image forming apparatus according to claim 24, further comprising recording material selecting means for selecting recording materials to be supplied from a plurality of recording material stacking portions, wherein during an operation of said recording material changeover means, a recording material is selected from said recording material selecting means.

29. An image forming apparatus according to claim 24, further comprising size detecting means for detecting a size of a selected recording material, wherein during a changeover of the recording material, a recording material greater in the width thereof in the direction orthogonal to the transport direction than the width of the recording material in the direction orthogonal to the transport direction before the changeover is selected on the basis of said size detecting means.

30. An image forming apparatus according to claim 24, wherein the recording material is changed over by said recording material changeover means when a difference between the temperature detected by said first temperature detecting means and the temperature detected by said second temperature detecting means is equal to or greater than a predetermined value.

31. An image forming apparatus according to claim 24, further comprising image rotating means for rotating a forming image orientation, wherein the forming image orientation is rotated through a predetermined angle in association with a changeover of the recording material by said recording material changeover means.

32. An image forming apparatus according to claim 31, further comprising image storing means for storing an image to be output, wherein a forming image orientation of a stored image is rotated through the predetermined angle.

33. An image forming apparatus according to claim 31, wherein the forming image orientation is rotated through approximately 90 degrees.

34. An image forming apparatus according to claim 24, wherein in a changing-over operation by said changeover means, the recording material is changed over to a recording material of the same size as the recording material before the changeover rotated through a predetermined angle with respect to the transport direction.

35. An image forming apparatus according to claim 34, wherein the predetermined angle through which the recording material is rotated is approximately 90 degrees.

36. An image forming apparatus comprising:

image forming means for forming an unfixed image on a recording material transported thereto, said image forming means being for forming images on recording materials differing in width thereof in a direction orthogonal to a transport direction thereof;

fixing means having a heat member and for fixing the unfixed image by use of heat and pressure;

count means for counting a number of recorded recording materials; and recording material changeover means, when images are to be formed on recording materials smaller in the width thereof in the direction orthogonal to the transport direction than a maximum width, for changing over the recording materials to recording materials greater in the width thereof in the direction orthogonal to the transport direction than the recording materials on which images are being formed, on the basis of said count means.

37. An image forming apparatus according to claim 36, further comprising recording material supplying means having at least one recording material stacking portion.

38. An image forming apparatus according to claim 37, further comprising recording material detecting means for detecting a presence or absence of recording materials contained in said recording material stacking portion, wherein said recording material stacking portion in which the presence of the recording materials has been detected by said recording material detecting means is selected.

39. An image forming apparatus according to claim 38, wherein warning is given when said recording material detecting means of the recording material stacking portion to be selected does not detect the presence of the recording materials.

40. An image forming apparatus according to claim 36, further comprising recording material selecting means for selecting recording materials to be supplied from a plurality of recording material stacking portions, wherein during a changeover of the recording material, a recording material is selected from said recording material selecting means.

41. An image forming apparatus according to claim 36, further comprising size detecting means for detecting a size of a selected recording material, wherein during changeover of the recording material, a recording material greater in the width thereof in the direction orthogonal to the transport direction than the width of the recording material in the direction orthogonal to the transport direction before the changeover is selected on the basis of said size detecting means.

42. An image forming apparatus according to claim 36, further comprising image rotating means for rotating a forming image orientation, wherein the forming image orientation is rotated through a predetermined angle in association with a changeover of the recording materials by said recording material changeover means.

43. An image forming apparatus according to claim 42, further comprising image storing means for storing an image to be output, wherein the forming image orientation of a stored image is rotated through the predetermined angle.

44. An image forming apparatus according to claim 42, wherein the forming image orientation is rotated through approximately 90 degrees.

45. An image forming apparatus according to claim 36, wherein in a changing-over operation by said changeover means, the recording material is changed over to a recording material of the same size as the recording material before the changeover rotated through a predetermined angle with respect to the transport direction.

46. An image forming apparatus according to claim 45, wherein the predetermined angle through which the recording material is rotated is approximately 90 degrees.

* * * * *